US005803351A

United States Patent [19]

Nielsen

[11] Patent Number: 5,803,351

[45] Date of Patent: Sep. 8, 1998

[54] METHOD OF DETECTING INCORRECTLY CLOSED FREEZING FRAME LINERS, AND A LINER AND A SYSTEM THEREFOR

[75] Inventor: Mogens Nielsen, Risskov, Denmark

[73] Assignee: Cartolit ApS, Athus N, Denmark

[21] Appl. No.: 776,017

[22] PCT Filed: Jul. 19, 1995

[86] PCT No.: PCT/DK95/00311

§ 371 Date: Jan. 17, 1997

§ 102(e) Date: Jan. 17, 1997

[87] PCT Pub. No.: WO96/02422

PCT Pub. Date: Feb. 1, 1996

[30] Foreign Application Priority Data

Jul. 19, 1994 [DK] Denmark ..... 0858/94

[51] Int. Cl.[6] ..... B65D 5/42

[52] U.S. Cl. ..... 229/198.2; 116/201; 156/378

[58] Field of Search ..... 229/198.2; 73/52, 73/865.8; 206/459.1, 459.5; 116/201, DIG. 41; 156/64, 116, 378, 379

[56] References Cited

U.S. PATENT DOCUMENTS

| | | | |
|---|---|---|---|
| 1,843,234 | 2/1932 | Karnes et al. | 116/201 |
| 3,533,548 | 10/1970 | Taterka | 116/201 |
| 3,616,898 | 11/1971 | Massie | 206/459.1 |
| 4,578,052 | 3/1986 | Engel et al. . | |
| 4,684,023 | 8/1987 | Cortopassi . | |
| 4,704,034 | 11/1987 | Takenaka et al. . | |
| 5,042,653 | 8/1991 | Ems | 206/459.1 |
| 5,103,979 | 4/1992 | Hustad . | |
| 5,234,732 | 8/1993 | Versic et al. | 206/459.1 |
| 5,249,550 | 10/1993 | Hines et al. . | |
| 5,427,266 | 6/1995 | Yun | 206/459.1 |
| 5,528,925 | 6/1996 | Sherepa et al. | 73/52 |

*Primary Examiner*—Gary E. Elkins
*Attorney, Agent, or Firm*—Sixbey, Friedman, Leedom & Ferguson; David S. Safran

[57] ABSTRACT

Carton liners are used in freezing frames for the preparation of large frozen blocks of fresh food material, e.g. fish fillets. The liners have a lid with skirt flaps to be closed upon filling of the liner, and care should be taken that the lid flaps be located at the outsides of the liner walls inside the freezing frame, as they may otherwise be embedded in the material to be frozen and thus disturb the regularity of the frozen block material. The same applies to corner flaps which, already by the mounting of the liner, should be folded to assume an exterior position. According to the invention, in order to ascertain a correct mounting and closing of the liners once they have been removed from the freezing frames, such liners are used which are provided with printed marking on those outside area portions that are to be covered by exterior liner/lid flaps, and the closed liners are inspected for detection of any visible marking, which will be indicative of a potentially defect block product.

10 Claims, 2 Drawing Sheets

Figure 1:
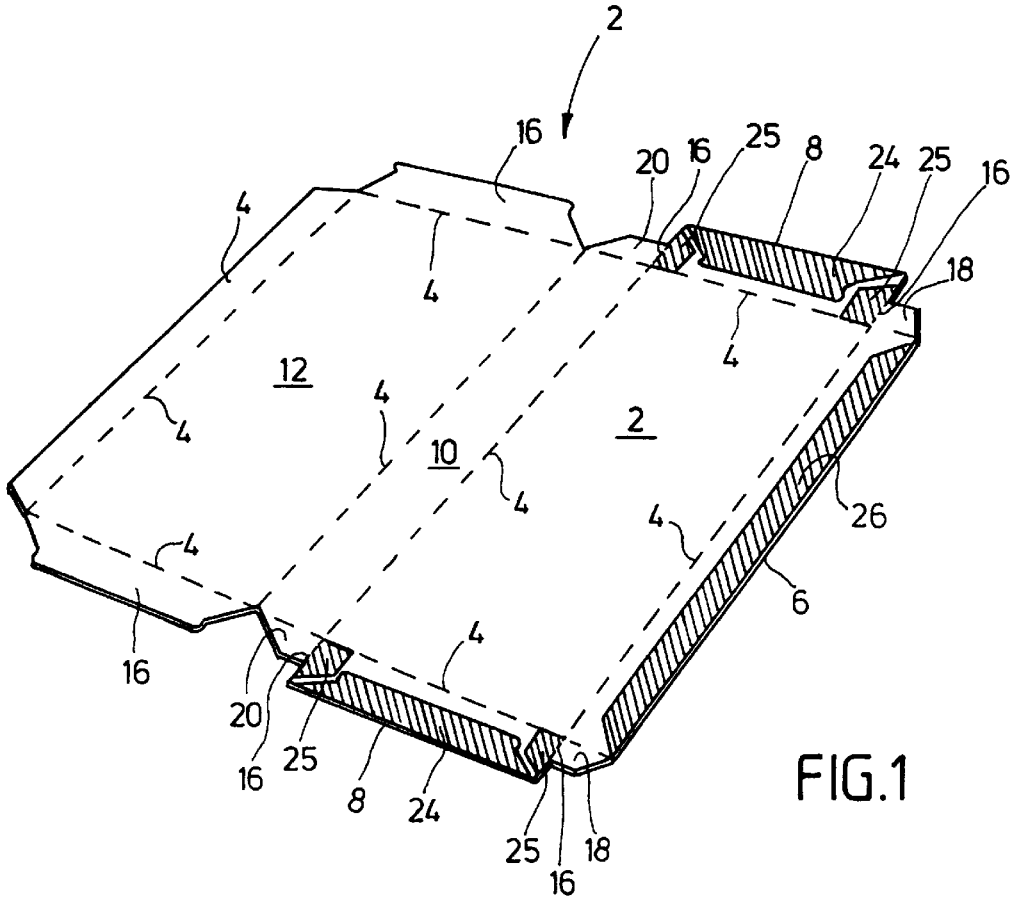

METHOD OF DETECTING INCORRECTLY CLOSED FREEZING FRAME LINERS, AND A LINER AND A SYSTEM THEREFOR

The present invention relates to a method of detecting an incorrect mounting or closing of packings of the carton liner type as used for packaging fresh food products to be frozen in freezing frames. Such liners, preferably with a coating of paraffin wax or the like, are used extensively in the fishing industry for the formation of relatively flat and broad blocks of fish, fish fillets or minced fish to be shipped to industrial users. The liners are made as quite simple blanks, with a bottom panel having four raisable wall flaps, of which a rear flap is continued in a lid panel also having wall or skirt flaps along its three free edges. Optionally, the front and rear wall flaps of the bottom panel may be laterally extended into corner flaps serving to improve the closure of the corners of the blank, when mounted in a frame.

The liners are used in connection with so-called freezing frames, having a rectangular opening accommodating the said bottom panel, which is simply forced down into the frame opening, whereby the wall flaps are easy to raise. The lid panel is left swung out from the lower box or tray portion as now erected and shape stabilized in the surrounding frame unit, and then the tray portion is filled with the relevant material. Thereafter the lid is folded inwardly over the tray, and the skirt flaps of the lid are folded down and introduced into the respective narrow spaces between the inside of the frame unit and the outsides of the raised tray walls. Then the entire assembly is passed to a freezing system of the shelf type. Once frozen, the liners with their block contents are ejected out of the freezing frames and delivered to a cold storage or a refrigerated van, while the frames are reused.

The industrial users of the relatively large blocks, typically measuring some 48×25 cm, peel off the liners and process the pure material blocks in frozen or temperated condition.

In closing the liners it is important that the lid skirt flaps are handled as mentioned, i.e. so as to be located at the outside of the tray walls. If, by mistake, one or more of them are lowered at the inside of the associated tray walls, they are likely to be introduced into the material filling out the tray portion, and get stuck therein by the subsequent freezing, whereby they are liable to remain in the frozen block material after the peeling off of the liner, i.e. they will be present, more or less invisibly, in the material to be processed. The same will apply to the said corner flaps, if used. Also these flaps should be folded so as to be located at the outside of the respective raised tray walls. The raising and closing work is normally effected purely manually, and since a high operation capacity is required the operators can rather easily make mistakes in the discussed respect.

Attempts of using auxiliary measures against such mistakes have generally failed, so far it is accepted that the manual handling of the liners will be associated with some kind of waste, and all what can be done is a visual inspection of the liners as released from the freezing frames. Such an inspection, however, is difficult and time consuming to carry out, because it is not readily ascertainable which flap is overlying another flap, so still a relatively high percentage of customer complaints has been found unavoidable.

According to the present invention, however, it has been recognized that in view of the specified conditions it is relatively easy to arrange for a very clear indication of 'which flap is covering which', viz. in adding to the liner blank a colored or otherwise visually differentiated marking of such blank sub areas, viz. the outsides of the innermost tray sides, which have to be externally covered by the lid skirt flaps, such that an inspection from outside will readily show whether the outwardly exposed flap surface is authorized or not.

According to the invention it will even be possible to arrange for an automatic detection of the outermost flap portions having the right color or characteristic to be accepted as a proof of a correct closing, e.g. in conveying piles of the deframed blocks past a scanning or vision station and, if required, rotate the piles to make the sensing equipment respond to possible occurrence of the characteristic "error color". The response may even be selective, as a basis for sorting the blocks into different groups for special processing based on the location of the faulty areas.

The invention, of course, will also comprise an inverted arrangement, by which it is a requirement that uncolored innermost walls should be covered by colored exterior flaps.

The invention also comprises the liner blanks for use with the discussed method. These blanks will be characterized merely in being provided with different colors or characters of the external surfaces of the wall or flap portions of the respective tray and lid sections. Preferably, the outsides of the lid skirt flaps have their natural color, while the outsides of the inner tray wall flaps have a suitable signal color or only marks of such a color; in principle, a single marking spot could be sufficient.

Correspondingly, if corner flaps are used, the liner blanks may carry a signal marking on the tray wall portions that are prescribed to be externally covered by the folded corner flaps.

The signal markings at the different relevant places may well be mutually different, e.g. having different colors or being different bar code markings whereby an automatic identification is facilitated.

It has not been customary to print the liner blanks, but once a printing can now be desired, it will be most advantageous to apply further printing details e.g. on the top side of the lid such as relevant bar codes and optically readable indications of various data, e.g. for further specification by cross marking.

Figure 2:
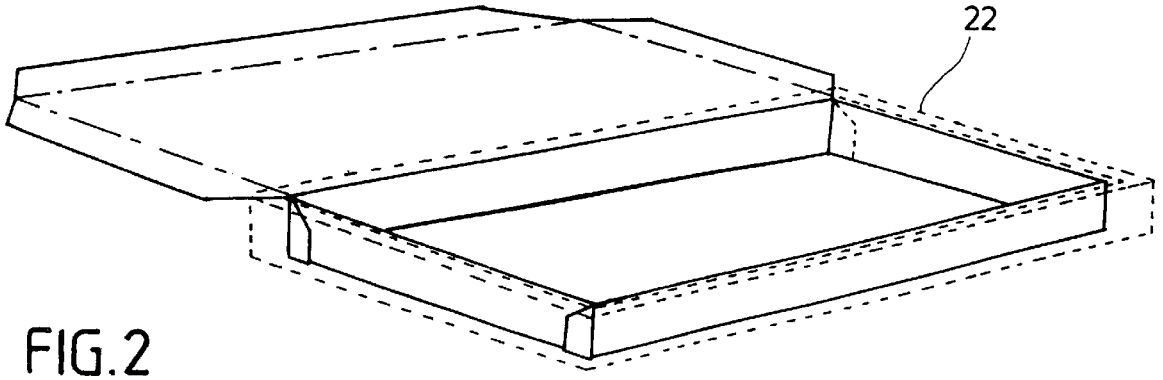
Figure 3:
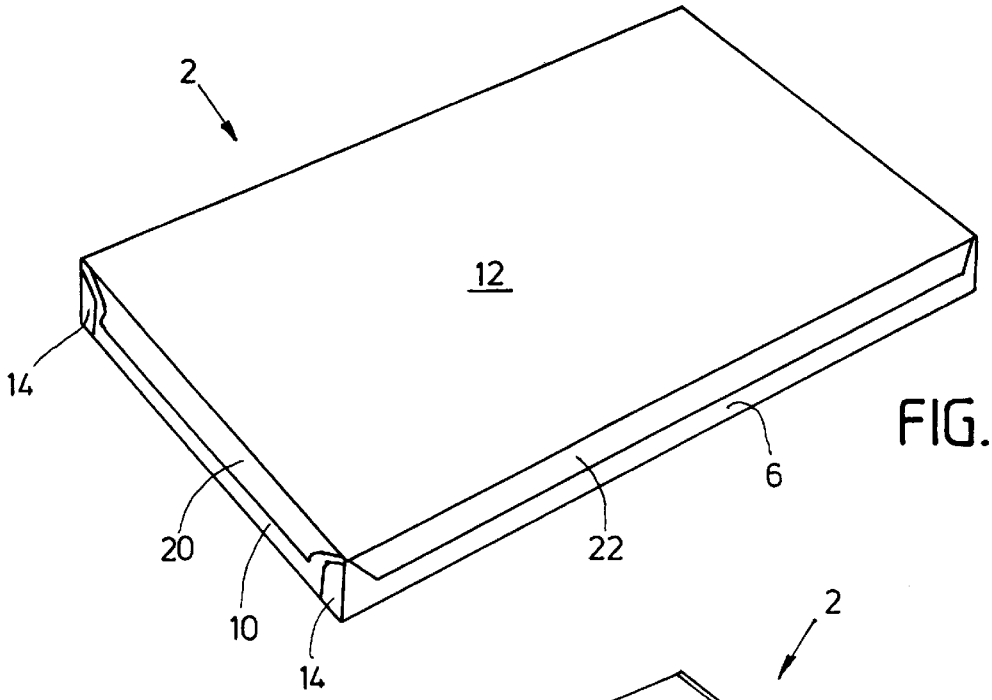
Figure 4:
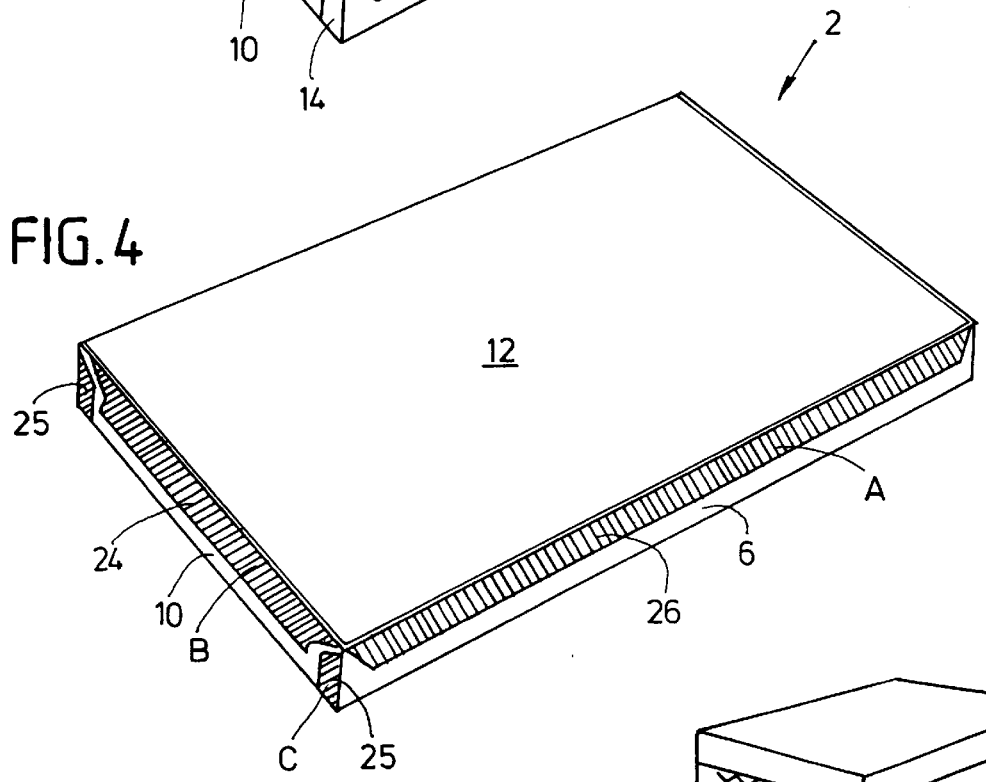
Figure 5:
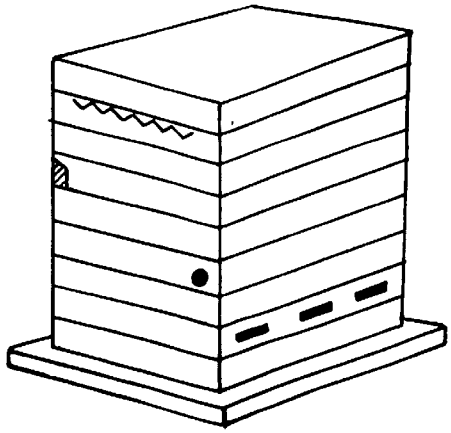

In the following the invention will be described in more detail with reference to the drawing, in which:

FIG. 1 is a perspective view of a liner blank according to the invention, seen from its outside, FIG. 2 is a perspective view of the tray bottom panel placed over the opening of a freezing frame as shown in phantom outline, FIG. 3 is a perspective view of the blank as forming an erected and correctly closed tray structure, FIG. 4 is a similar view of the tray structure closed in a wrong manner, and FIG. 5 is a perspective view of a pile of such tray structures, showing both correctly and incorrectly closed packagings.

The blank shown in FIG. 1 is a one-layer carton member shaped as a conventional freezing frame liner and coated at both sides with paraffin or the like. The blank has a tray bottom panel 2 confined by folding lines 4 and projecting beyond these into a front wall flap 6, opposed lateral wall flaps 8 and a rear wall flap 10, the latter continuing in a lid panel 12, which is extended across folding lines 4 into a front skirt flap 14 and opposed lateral skirt flaps 16.

Some liners consist of just these parts, but preferably the front and rear wall flaps 6 and 10 of the tray portion have laterally projecting end or corner flaps 18 and 20, respectively.

In use, the liner blank is placed over a freezing frame 22 as shown in dotted lines in FIG. 2, with the tray bottom panel 2 placed over the inner opening of the frame, preferably with the wall flaps more or less pre-erected, whereafter the panel 2 is pressed downwardly in the frame, this causing the wall flaps 6, 8 and 10 to be fully erected, while the lid section 12, 14, 16 is kept folded out from the frame.

Thereafter the erected tray section 2, 6, 8, 10 is filled with the relevant fresh food material, e.g. fish meat, and then the lid is closed over the box with the lid skirt flaps 14 and 16 folded downwardly along the tray walls 6 and 8. Then the freezing frame with the closed, flat tray packing is passed to a freezing unit and thereafter the block packing is deframed and delivered to a customer.

Already by the erection of the tray section in the frame 22 the operator should take care of ensuring that the said end flaps 18 and 20 of the wall portions 6 and 10 be folded into final positions at the outsides of the lateral tray wall flaps 8, as illustrated in FIG. 2. These end flaps could well end up in a position at the inside of the walls, and in that case it would be a possibility that the end flaps could be embedded and thus frozen into the food material, contaminating the entirety thereof.

The same will be true as far as the lid skirt flaps 14, 16 are concerned. When the lid is closed it is even more important that these skirt flaps be stuck down along the outsides of the wall flaps 6, 8, i.e. in the narrow space between these outsides and the inside of the frame 22. The operators have to be very careful in this respect, but mistakes will be unavoidable, potentially resulting in complaints from the customers.

A deframed block package is illustrated in FIG. 3. A close visual inspection will ascertain whether all relevant flap portions 14, 16, 18, 20 are actually located at the outside of the tray walls 6 and 8, but such an inspection is difficult to carry out with a high capacity, solely based on the occurrence of the contour of the said flap portions at the exterior of the tray walls.

It will be noted that the corner flaps 18 and 20 are cut with a sloping top edge and that also the adjoining ends of the lateral skirt flaps 16 are obliquely cut, such that at the corners there will be no over-lapping between these parts. It is ensured thereby that nowhere in the walls of the closed liner there will more that two carton layers, and the closed flaps 18 and 20 remain fully visible and uncovered by the lateral lid skirts.

According to the invention, the outsides of the tray walls 6 and 8 are provided with visible markings A, B and C at the areas covered by the respective elements 14, 16 and 18 in the correctly closed block packing. These markings, which are shown in FIG. 1 —provided the blank is illustrated upside down, may be of any desired kind, whether fully colored, hatched, dotted or the like. They are shown also in FIG. 4, which represents a liner having been closed totally wrongly, with corner flaps 18 and 20 with lid skirt flaps 18, 20 located at the inside of the corners and with lid skirt elements 14, 16 located inside the tray walls 6 and 8. It is directly observable that the wrong closing gives rise to a marked signaling from the block packing, compared with FIG. 3.

The markings should not necessarily fill out the entire relevant surface areas, and FIG. 5 shows some examples of different markings on some wrongly closed block packings placed between correctly closed packings in a pile. The markings will be clearly visible or detectable, without any need of checking the presence of the non-marked contours of the outer elements 14, 16, 18, 20 at the outside of the tray walls 6, 8.

In an automatic detection system as also comprised by the invention and including e.g. a scanner or a vision unit, it will be possible to carry out a selective detection of signal markings appearing at different specific positions and thereby to effect a sorting out of erroneous block packaging into respective positions all according to the location of the error. To this end, as mentioned, the markings may be mutually different colors or be provided as bar codes or other automatically readable markings.

I claim:

1. Method of detecting an incorrect mounting or closing of packings of the carton liner type as used for packing food products to be frozen in freezing frames, these frame liners comprising a bottom part with erectable wall flaps and a lid part with lid skirt flaps to be located at the outside of the corresponding wall flaps in correctly closed packings, characterized in using for the packaging carton liners provided with a colored or otherwise visually differentiated marking (24, 25, 26) on at least some of such sub areas, such as sub areas of the outsides of the innermost liner wall flaps (6, 8), which have to be externally covered by other portions of the liner, e.g. by lid skirt flaps (4, 16) and/or corner flaps (18, 20) and, after deframing of the frozen packings, effecting inspection of the packings so as to respond to a detection of any said marking being exposed on the packings.

2. Method according to claim 1, characterized in that the inspection is effected by detector means responsive to visual occurrence of the said marking on any surface area of the packings.

3. Method according to claim 1, characterized in that the detector means are used to provide indication of the location of the faulty areas, such information being used as basis for sorting out the blocks into different groups.

4. Liner blank for use with the method according to claim 1, comprising a bottom part (2) with erectable wall flaps (6, 8) and a lid part (12) with lid skirt flaps (14, 16) to be folded down from at least one edge of a lid panel (12) hinged to a rear wall flap (10) of the bottom part (2) along its fourth edge, characterized in being provided with mutually different colors, surface character or markings (24, 25, 26) on the external surfaces of the wall flaps of the bottom part, which are adapted to be covered by the lid skirt flaps, and the outside of the lid skirt flaps themselves, respectively, and —where corner flaps are used —preferably also on the external sub areas of said wall flaps adapted to be covered by the corner flaps and on the outsides of the flaps themselves, respectively.

5. Liner blank according to claim 4, characterized in that the outsides of the lid skirt flaps (20, 22) have their natural color, while the portions of the outsides of the wall flaps (6, 10) adapted to be covered by the skirt flaps have a suitable signal colour or marks of such colour.

6. Liner blank according to claim 4, characterized in that the characters or marks (24, 25, 26) on the cardboard liner (2) are stigmatized into the relevant surface portions thereof.

7. Liner blank according to claim 4, characterized in that the characters or marks (24, 25, 26) are of the bar code type, the magnetic stripe type or the punctured type.

8. Liner blank according to claim 4, characterized in that the characters or marks (24, 25, 26) are of mutually different colors or types all according to their location on the liner.

9. A system for detecting incorrectly arranged liners according to claim 5, appearing as a wrapping about frame frozen material blocks, after deframing thereof, characterized in comprising scanning or vision means responsive to detection of an incorrect color, character or marking appearing on any side wall portion of the blocks as presented to the scanning or vision means consecutively one by one or in piled groups.

10. A system according to claim 9, characterized in comprising means for selective identification of errors occurring at different characteristic locations on the single liners.

* * * * *